US009145678B1

(12) United States Patent
Wang et al.

(10) Patent No.: US 9,145,678 B1
(45) Date of Patent: Sep. 29, 2015

(54) DUAL-PURPOSE LIGHTING AND CEILING GRID FRAMEWORK

(71) Applicants: Cheng-Peng Wang, Taichung (TW); Jen-Chieh Wang, Taichung (TW)

(72) Inventors: Cheng-Peng Wang, Taichung (TW); Jen-Chieh Wang, Taichung (TW)

( * ) Notice: Subject to any disclaimer, the term of this patent is extended or adjusted under 35 U.S.C. 154(b) by 0 days.

(21) Appl. No.: 14/640,132

(22) Filed: Mar. 6, 2015

(30) Foreign Application Priority Data

Mar. 12, 2014 (TW) ..... 103108735 A

(51) Int. Cl.

| | |
|---|---|
| ***E04F 19/00*** | (2006.01) |
| ***E04B 9/00*** | (2006.01) |
| ***E04B 9/06*** | (2006.01) |
| ***H01K 1/18*** | (2006.01) |

(52) U.S. Cl.
CPC ..... *E04B 9/006* (2013.01); *E04B 9/068* (2013.01); *H01K 1/18* (2013.01)

(58) Field of Classification Search
None
See application file for complete search history.

(56) References Cited

U.S. PATENT DOCUMENTS

| | | | | |
|---|---|---|---|---|
| 3,385,021 | A * | 5/1968 | Nys | 52/665 |
| 8,096,671 | B1 * | 1/2012 | Cronk et al. | 362/147 |
| 8,955,998 | B2 * | 2/2015 | Wong et al. | 362/147 |
| 2007/0247842 | A1 * | 10/2007 | Zampini et al. | 362/227 |
| 2010/0103654 | A1 * | 4/2010 | Yasuda et al. | 362/147 |

FOREIGN PATENT DOCUMENTS

| | | | | |
|---|---|---|---|---|
| WO | WO 2011112261 | * | 9/2011 | F21V 21/02 |
| WO | WO 2011112261 | A2 * | 9/2011 | |

* cited by examiner

*Primary Examiner* — Brian Glessner
*Assistant Examiner* — Adam Barlow
(74) *Attorney, Agent, or Firm* — Trop, Pruner & Hu, P.C.

(57) ABSTRACT

In a ceiling grid framework, at least one of a main beam and front and rear cross beams is configured to have a beam module which includes a lighting element therein. Thus, the ceiling grid framework can be used for supporting ceiling panels and for illumination.

7 Claims, 9 Drawing Sheets

DUAL-PURPOSE LIGHTING AND CEILING GRID FRAMEWORK

CROSS-REFERENCE TO RELATED APPLICATION

This application claims priority from Taiwanese application no. 103108735, filed on Mar. 12, 2014, the disclosure of which is incorporated in its entirety herein by reference.

FIELD OF THE INVENTION

This invention relates to a ceiling grid framework, more particularly to a dual-purpose lighting and ceiling grid framework.

BACKGROUND OF THE INVENTION

A suspended ceiling is normally used in commercial and industrial buildings, and includes a ceiling grid framework configured to have a plurality of grids which can be used to support ceiling panels, lighting fixtures, or other devices (such as air conditioning vent/intake covers, etc.). Sometimes, the mounting of lighting fixtures on the grids is restricted by other devices or the building structure, e.g., concrete beams of the building. Thus, in a room space under the ceiling grid framework, there might be relatively dark areas.

SUMMARY OF THE INVENTION

An object of the present invention is to provide a dual-purpose lighting and ceiling grid framework which can be used to provide uniform illumination in a room space below the ceiling grid framework and for supporting ceiling panels, air conditioning vent/intake covers, etc.

According to the present invention, a dual-purpose lighting and ceiling grid framework includes a main beam and front and rear cross beams. The main beam extends in a longitudinal direction and is formed with a slot. Each of the front and rear cross beams extends in a transverse direction relative to the longitudinal direction to terminate at front and rear end regions. The rear end region of the front cross beam is connected to the front end region of the rear cross beam through the slot of the main beam. At least one of the main beam and the front and rear cross beams is configured to have a beam module including a vertical web portion, two shoulder portions, two side frame portions, two flange portion, and a lighting element. The vertical web portion extends in an upright direction transverse to both the longitudinal and transverse directions to terminate at upper and lower ends. The shoulder portions extend transversely relative to the upright direction and oppositely from the lower end to terminate at two shoulder ends, respectively. The shoulder portions cooperatively define a mounting seat. Each of the side frame portions extends downwardly from a corresponding one of the shoulder ends to terminate at a frame end. The side frame portions define an accommodation space therebetween. The flange portions extend respectively from the frame ends of the side frame portions. The lighting element is disposed in the accommodation space, and includes a circuit board mounted on the mounting seat, and a plurality of light-emitting diodes disposed on the circuit board to give out illuminating light.

BRIEF DESCRIPTION OF THE DRAWINGS

Other features and advantages of the present invention will become apparent in the following detailed description of the embodiments of the invention, with reference to the accompanying drawings, in which.

DETAILED DESCRIPTION OF THE EMBODIMENTS

Figure 1:
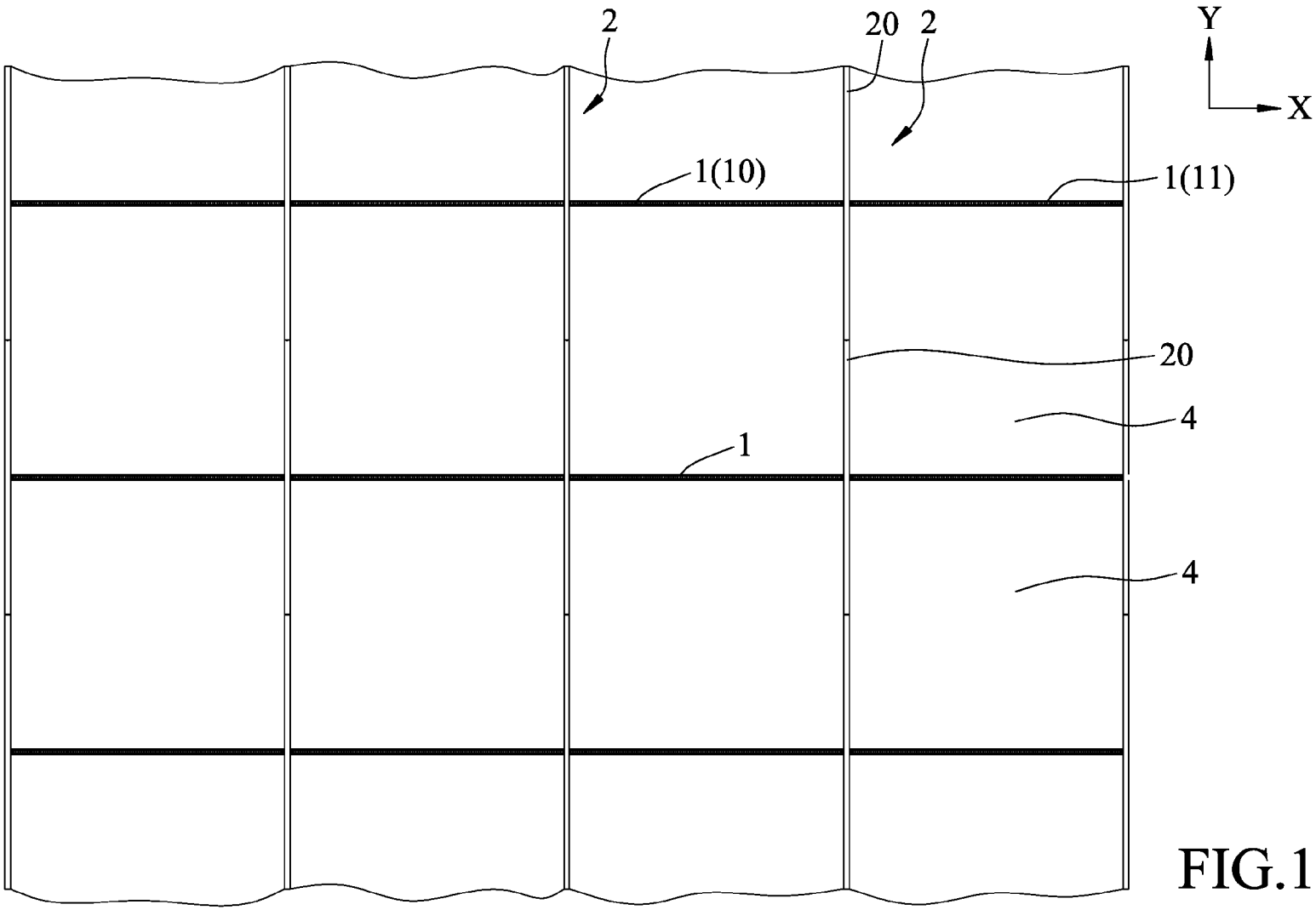
FIG. 1 is a fragmentary bottom view of a suspended ceiling grid system which includes ceiling panels and a lighting and ceiling grid framework according to a first embodiment of the present invention.

Before the present invention is described in greater detail, it should be noted herein that same reference numerals are used to denote like elements throughout the specification.

FIG. 1 shows a dual-purpose lighting and ceiling grid according to a first embodiment of the present invention used in a suspended ceiling grid system. The dual-purpose lighting and ceiling grid can be used for illumination and for supporting ceiling panels 4 or other devices (such as air conditioning vent/intake covers, not shown). The dual-purpose lighting and ceiling grid framework includes a plurality of parallel main beams 2 and a plurality of cross beams 1. The main beams 2 and the cross beams 1 are interconnected to form a plurality of grids for supporting the ceiling panels 4 or other devices. Each of the main beams 2 is constituted by a plurality of support members 20 that are assembled in aligned end-to-end relation.

For better illustration of the dual-purpose lighting and ceiling grid framework, only one main beam 2 (including one support member 20) and two cross beams 1 (i.e., a front cross beam 10 and a rear cross beam 11) are described below with reference to FIGS. 2 and 3.

Figure 6:
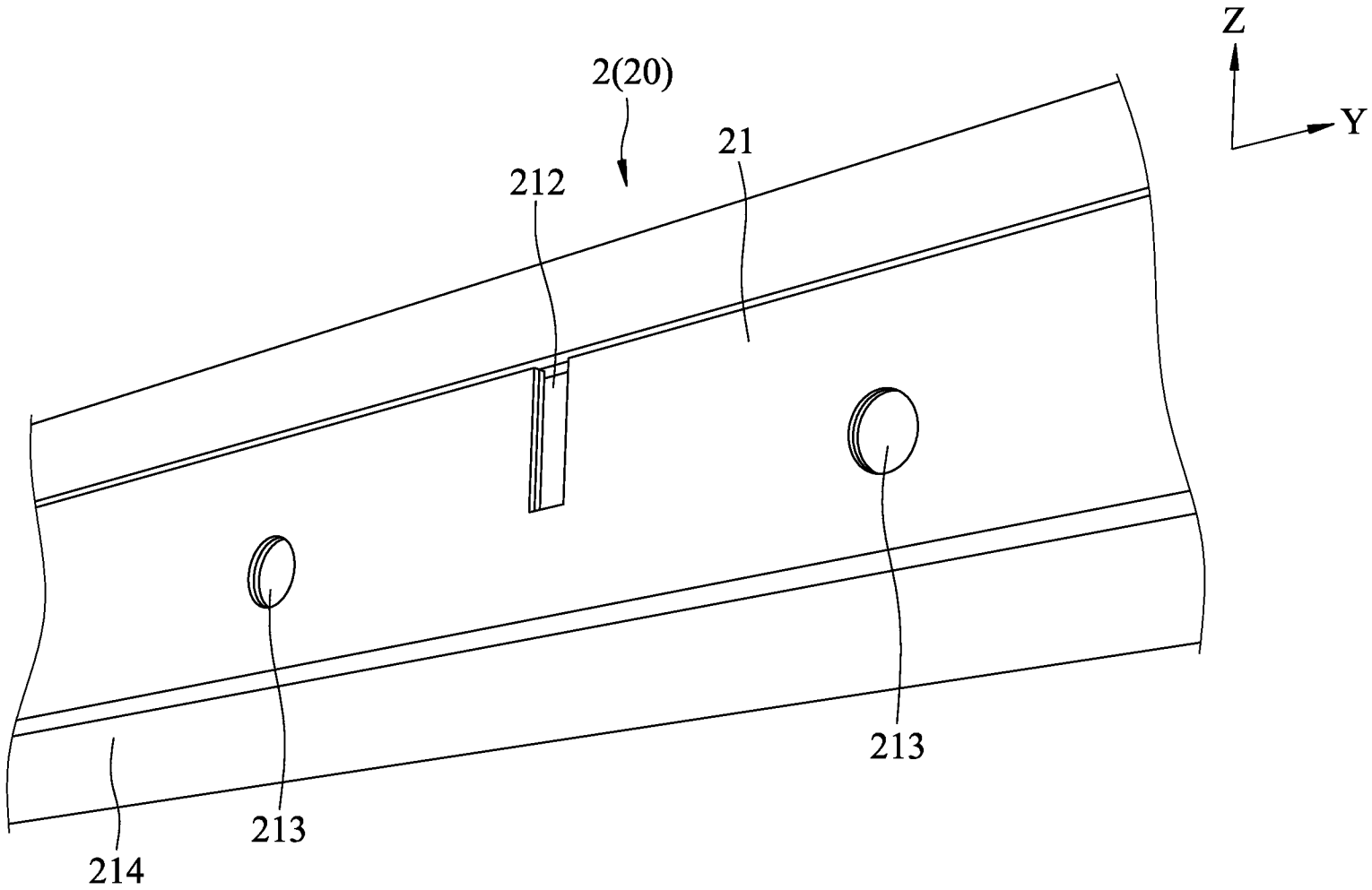
FIG. 6 is a fragmentary perspective view illustrating the support member of the main beam.

The main beam 2 extends in a longitudinal direction (Y) and is formed with a slot 212 (see also FIG. 6).

Each of the front and rear cross beams 10, 11 extends in a transverse direction (X) relative to the longitudinal direction (Y) to terminate at front and rear end regions 101, 102. The rear end region 102 of the front cross beam 10 is connected to the front end region 101 of the rear cross beam 11 through the slot 212 of the main beam 2 at a right angle relative to the main beam 2.

At least one of the main beam. 2 and the front and rear cross beams 10, 11 is configured to have a beam module 100 (FIG. 5) which includes a lighting element 12.

In this embodiment, each of the front and rear cross beams 10, 11 has the beam module 100. The main beam 2 has an inverted T-shaped cross section, and includes a vertical web portion 21 extending in an upright direction (Z), and two flange portions 214 extending oppositely from a lower end of the vertical web portion 21 in the transverse direction (X), for supporting marginal portions of the ceiling panels 4. The vertical web portion 21 is formed with the slot 212 and two through holes 213. The main beam 2 is suspended on wires (not shown) which extend through the through holes 213, and which are fixed to an overhead structure above the lighting and ceiling grid framework.

Figure 4:
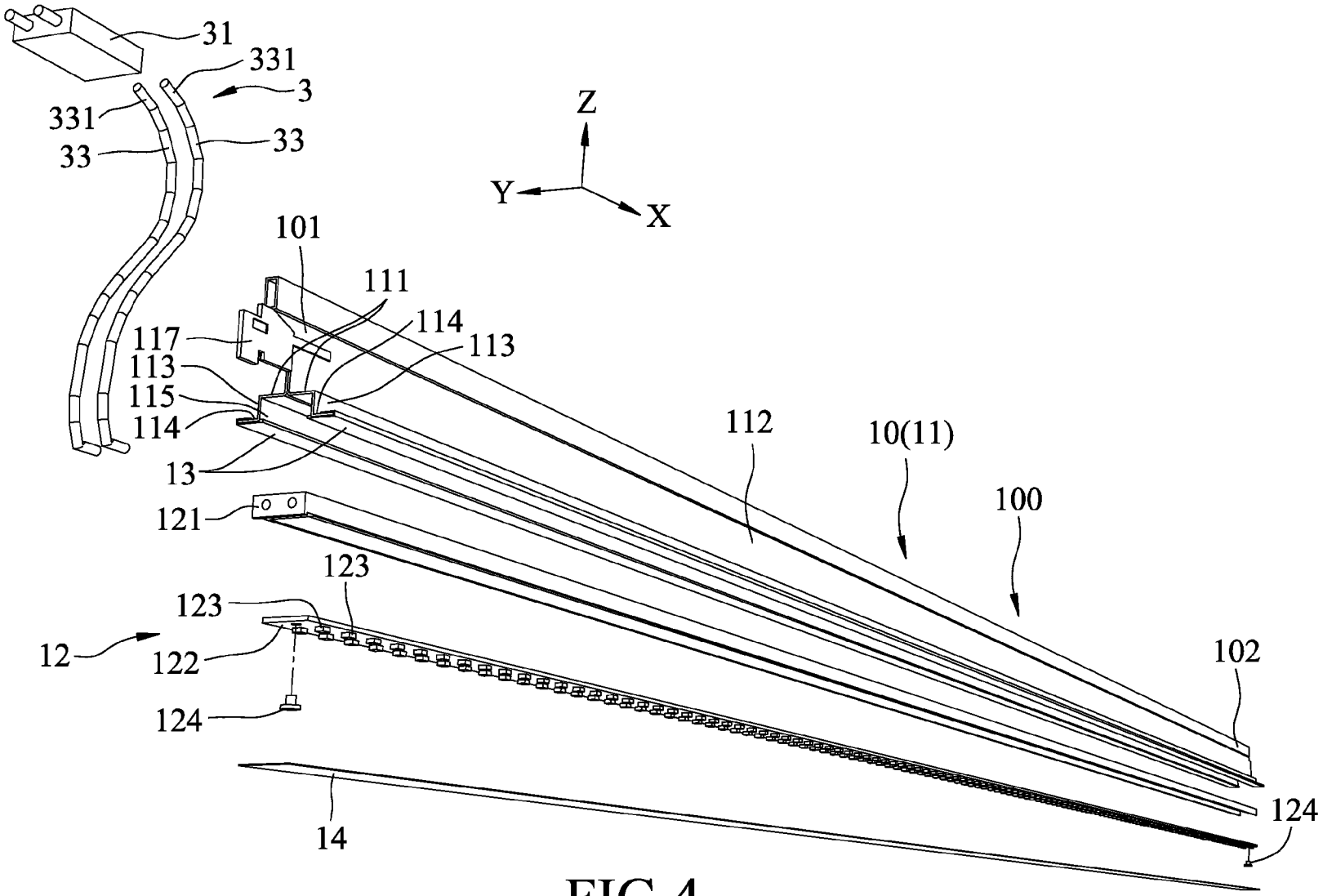
FIG. 4 is a fragmentary exploded perspective view illustrating a beam module of each cross beam.
Figure 5:
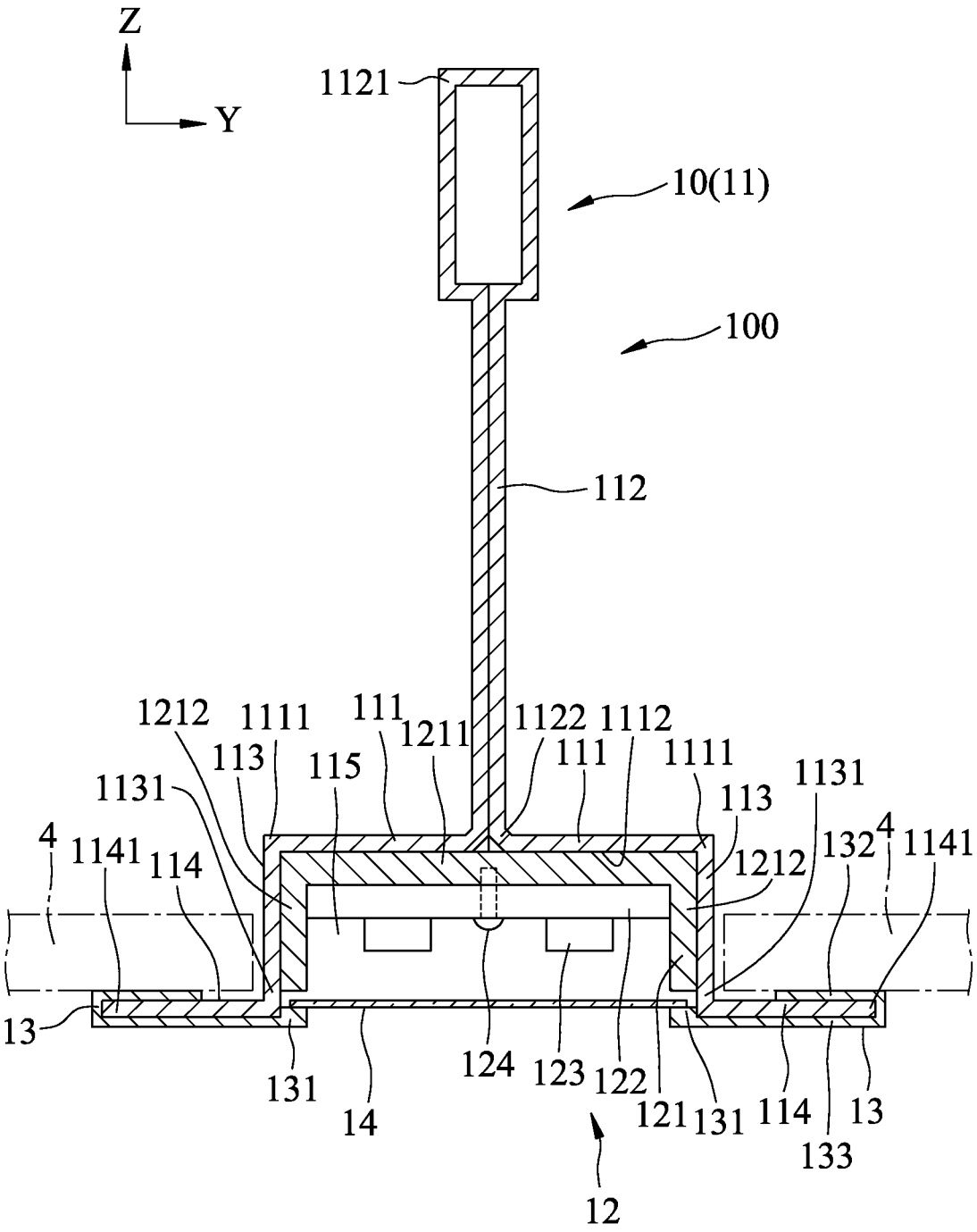
FIG. 5 is a cross-sectional view taken along line V-V of FIG. 2.

As best shown in FIGS. 4 and 5, the beam module 100 includes a vertical web portion 112, two shoulder portions 111, two side frame portions 113, two flange portions 114, and the lighting element 12.

The vertical web portion 112 extends in an upright direction (Z) transverse to both the longitudinal and transverse directions (Y, X) to terminate at upper and lower ends 1121, 1122.

The two shoulder portions 111 extend transversely relative to the upright direction (Z) and oppositely from the lower end 1122 to terminate at two shoulder ends 1111, respectively. The shoulder portions 111 cooperatively define a mounting seat 1112. In this embodiment, the shoulder portions 111 extend in the longitudinal direction (Y) to terminate at the shoulder ends 1111, respectively.

Each of the side frame portions 113 extends downwardly from a corresponding one of the shoulder ends 1111 to terminate at a frame end 1131. The side frame portions 113 define an accommodation space 115 therebetween.

The two flange portions 114 extend respectively from the frame ends 1131 of the side frame portions 113 and away from each other. Please note that the marginal portions of the ceiling panels 4 can be supported by the flange portions 114 or the shoulder portions 111 of the beam module 100.

In this embodiment, the flange portions 114 extend in the longitudinal direction (Y) to terminate at two flange ends 1141, respectively. Each of the flange portions 114 has a flange length which extends in the longitudinal direction (Y), and which is substantially the same as a length of each of the side frame portions 113 that extends in the upright direction (Z). Furthermore, as shown in FIG. 2, each of the flange portions 114 extends continuously in the transverse direction (X). Alternatively, each of the flange portions 114 may be constituted by a plurality of flange regions (not shown) that are spaced apart from each other in the transverse direction (X), as long as the flange regions are of a number sufficient to support the marginal portions of the ceiling panels 4.

The lighting element 12 is disposed in the accommodation space 115, and includes a circuit board 122 mounted on the mounting seat 1112, and a plurality of light-emitting diodes 123 disposed on the circuit board 122 to give out illuminating light.

In this embodiment, the lighting element 12 further includes a reflective shade 121. The reflective shade 121 includes a top mounting wall 1211 and two reflective walls 1212. The top mounting wall 1211 is disposed between the mounting seat 1112 and the circuit board 122, and is adhesively bonded to the mounting seat 1112. The circuit board 122 is mounted to the top mounting wall 1211 by two screws 124 (FIGS. 4 and 5). The reflective walls 1212 extend downwardly from the top mounting wall 1211 along the side frame portions 113, respectively, for reflecting light emitted from the light-emitting diodes 123.

In this embodiment, the beam module 100 further includes two side covers 13 and a flat shield 14. Each of the side covers 13 includes upper and lower abutment walls 132, 133 that are spaced apart from each other in the upright direction (Z) so as to permit a corresponding one of the flange portions 114 to be sandwiched therebetween. The lower abutment walls 133 of the side covers 13 extend toward each other beyond the frame ends 1131 of the side frame portions 113, respectively, so as to form two support edges 131, respectively. The flat shield 14 is disposed under the light-emitting diodes 123 and is supported by the support edges 131.

Figure 2:
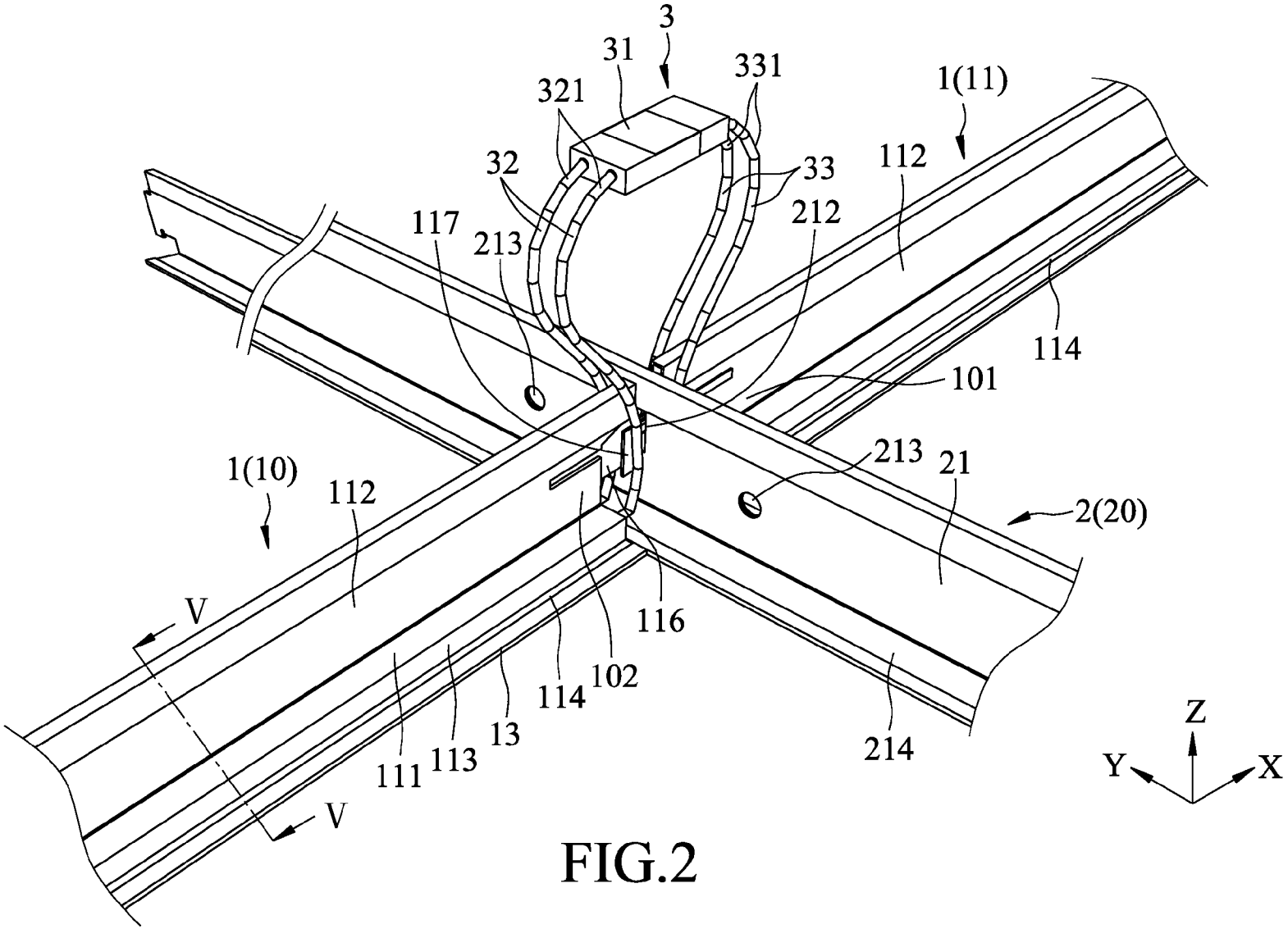
FIG. 2 is a fragmentary perspective view of the lighting and ceiling grid framework.
Figure 3:
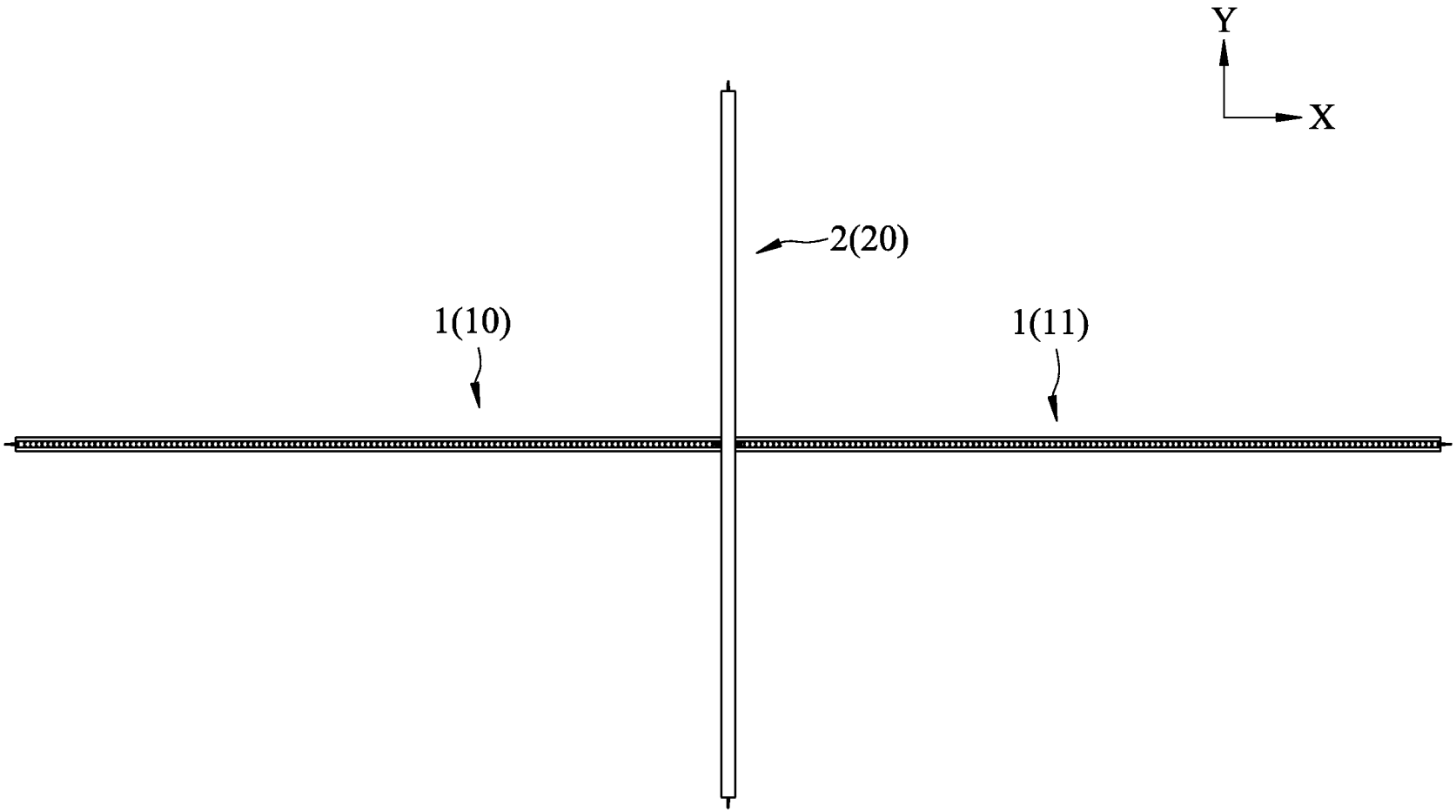
FIG. 3 is a bottom view illustrating two cross beams and a support member of a main beam in the lighting and ceiling grid framework of FIG. 1.

As best shown in FIG. 2, a flexible electrical connecting unit 3 is disposed to electrically interconnect the circuit boards 122 of the front and rear cross beams 10, 11. The flexible electrical connecting unit 3 includes a connector 31, a pair of front cables 32, and a pair of rear cables 33.

Each of the front cables 32 includes two opposite ends, one of which is electrically connected to the circuit board 122 of the front cross beam 10, and the other of which is a front terminal end 321. Each of the rear cables 33 has two opposite ends, one of which is electrical connected to the circuit board 122 of the rear cross beam 11, and the other of which is a rear terminal end 331. The connector 31 is configured to electrically connect the front terminal ends 321 of the front cables 32 to the rear terminal ends 331 of the rear cables 33. Each of the front and rear cables 32, 33 is a self-standing cable that supports the connector 31 over the main beam 2.

Figure 7:
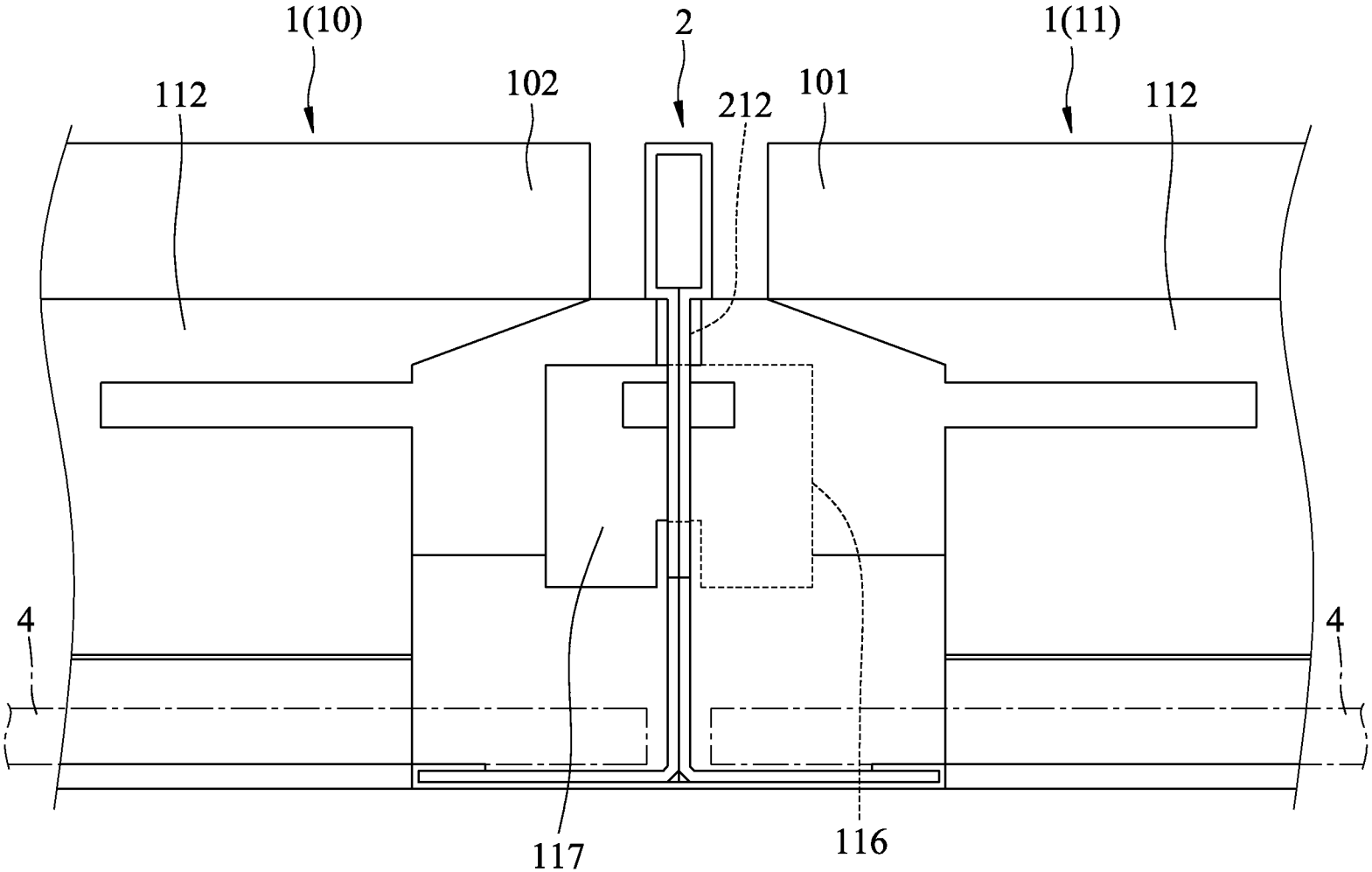
FIG. 7 is a fragmentary side view of the lighting and ceiling grid framework shown in FIG. 3.

With reference to FIGS. 2 and 7, the rear end region 102 of the front cross beam 10 is punched in the vertical web portion 112 of the front cross beam 10 to form a left offset hook tab 116, and the front end region 101 of the rear cross beam 11 is punched in the vertical web portion 112 of the rear cross beam 11 to form a right offset hook tab 117. The left and right offset hook tabs 116, 117 are brought into engagement with the slot 212 such that the left and right offset hook tabs 116, 117 are partially overlapped and are juxtaposed with each other to thereby permit the front and rear cross beams 10, 11 to be aligned with each other in the transverse direction (X).

Each of the main beam 2 and the front and rear beams 10, 11 may conveniently be an extruded aluminum section, in which the aforementioned ends, tabs, slot, and holes are formed by cutting and punching after extrusion.

Figure 8:
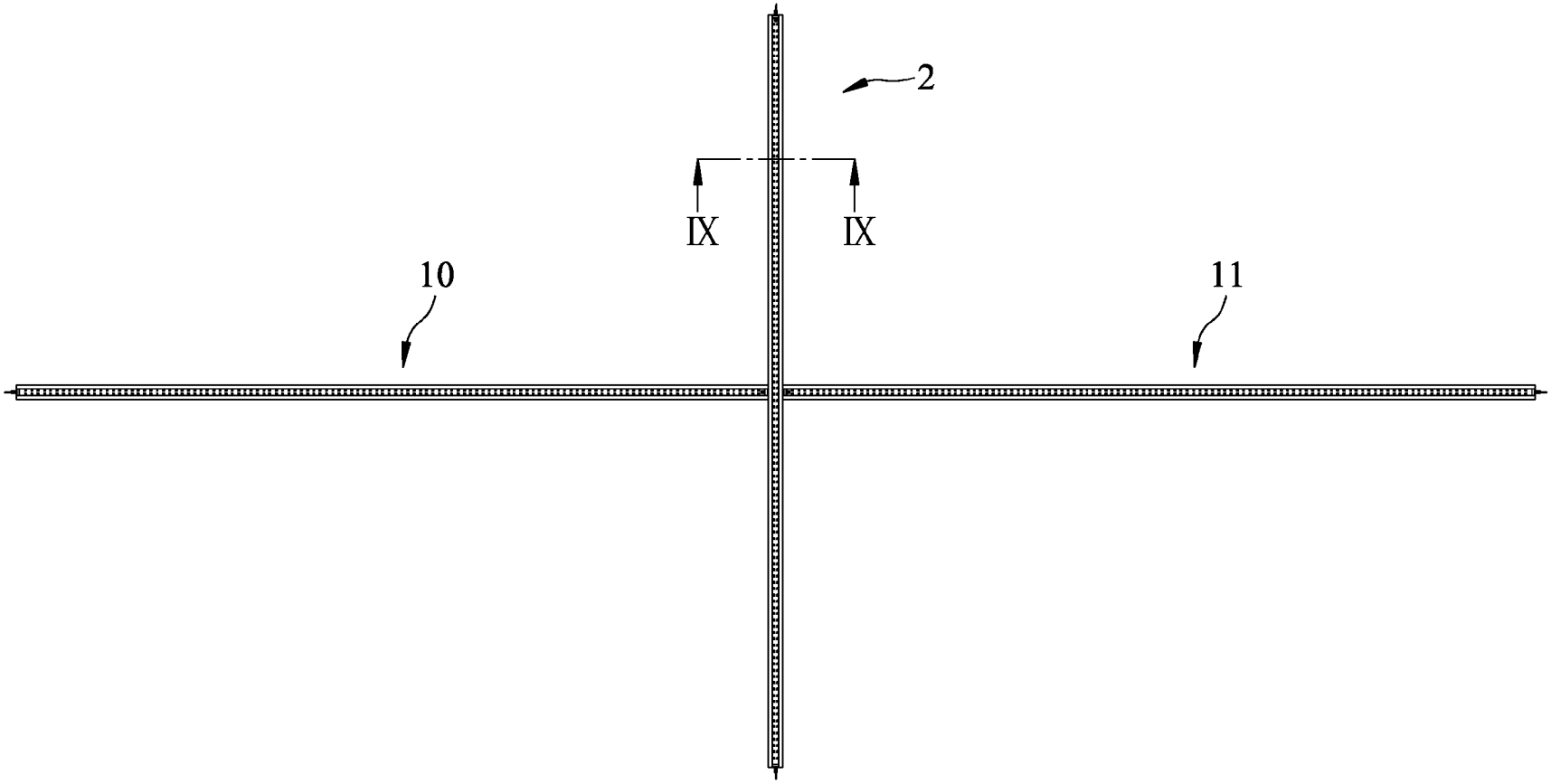
FIG. 8 is a bottom view illustrating two crossbeams and a support member of a main beam in a lighting and ceiling grid framework according to a second embodiment of the present invention.
Figure 9:
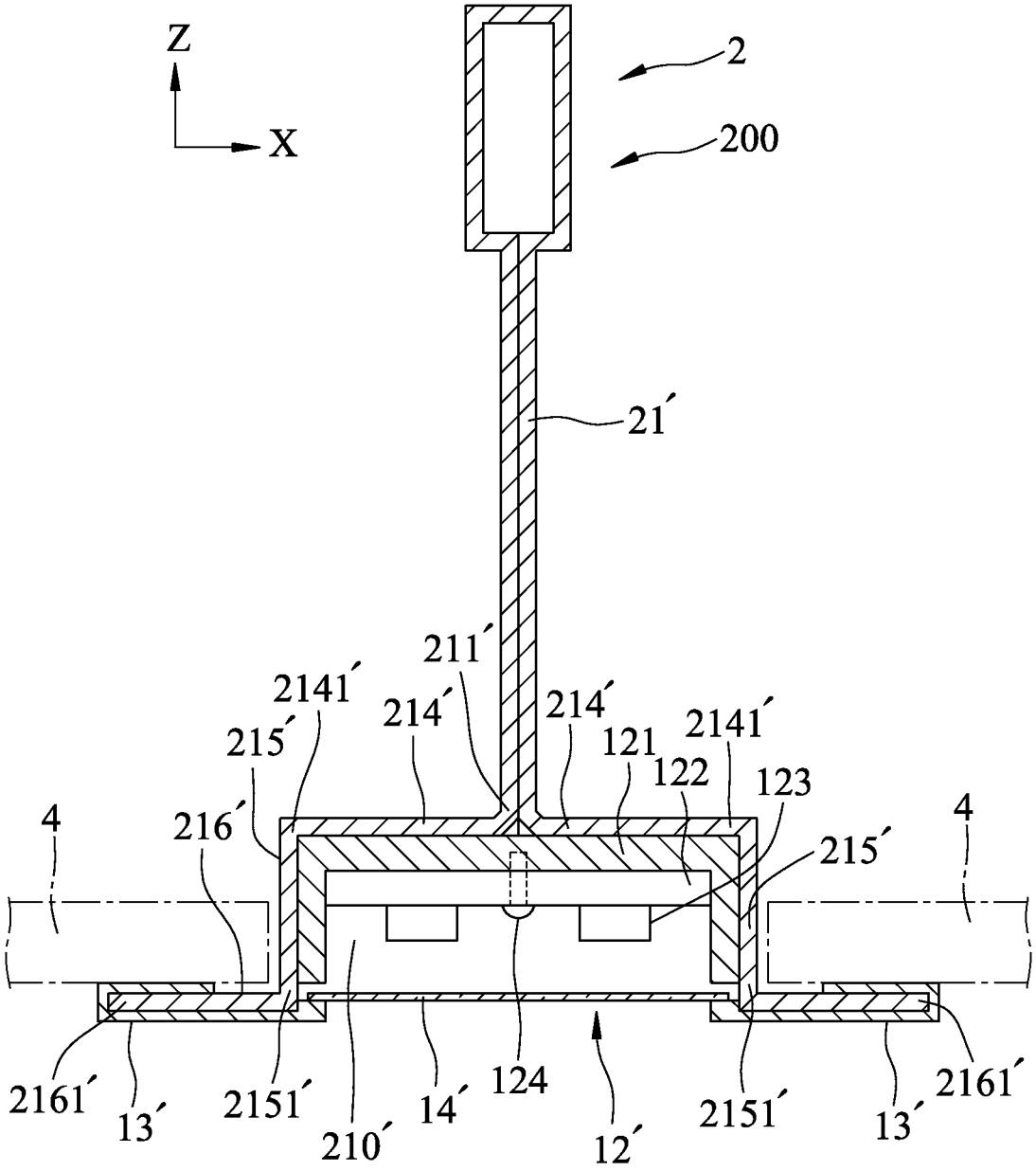
FIG. 9 is a cross-sectional view taken along line IX-IX of FIG. 8.

FIGS. 8 and 9 show a dual-purpose lighting and ceiling grid framework according to a second embodiment of the present invention. In the second embodiment, each of the front and rear cross beams 10, 11 includes the beam module 100 which is the same as that shown in FIG. 5, and which are already described above in connection with the first embodiment, and the main beam 2 includes a beam module 200 similar to the beam module 100.

As shown in FIG. 9, the beam module 200 of the main beam 2 includes a vertical web portion 21', two shoulder portions 214', two side frame portions 215', two flange portions 216', the lighting element 12', two side covers 13', and a flat shade 14', which are similar to the vertical web portion 112, the shoulder portions 111, the side frame portions 113, the flange portions 114, the lighting element 12, the side covers 13, and the flat shade 14 of the beam module 100 of each of the front and rear cross beams 10, 11, respectively.

In the second embodiment, the shoulder portions 214' extend oppositely from a lower end 211' of the vertical web portion 21' in the transverse direction (X) to terminate at two shoulder ends 2141', respectively. Each of the side frame portions 215' extends downwardly from a corresponding one of the shoulder ends 2141' to terminate at a frame end 2151'. The side frame portions 215' define an accommodation space 210' therebetween. The flange portions 216' extend in the transverse direction (X) to terminate at two flange ends 2161', respectively.

With the dual-purpose lighting and ceiling grid framework of the present invention, a room space under the ceiling grid framework can be uniformly illuminated, and the arrangement of the air conditioning vent/intake covers (not shown) or other devices on the dual-purpose lighting and ceiling grid framework is less restricted. In addition, because the dual-purpose lighting and ceiling grid framework is provided with lighting elements, i.e., it does not need to support conventional lighting fixtures, the loading thereof can be greatly reduced. Furthermore, the flat shade 14 is removable to permit easy replacement of the light-emitting diodes 123.

While the present invention has been described in connection with what are considered the most practical embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A dual-purpose lighting and ceiling grid framework, comprising:

a main beam extending in a longitudinal direction and formed with a slot; and front and rear cross beams each extending in a transverse direction relative to the longitudinal direction to terminate at front and rear end regions, said rear end region of said front cross beam being connected to said front end region of said rear cross beam through said slot of said main beam, wherein at least one of said main beam and said front and rear cross beams is configured to have a beam module including a vertical web portion extending in an upright direction transverse to both the longitudinal and transverse directions to terminate at upper and lower ends, two shoulder portions which extend transversely relative to the upright direction and oppositely from said lower end to terminate at two shoulder ends, respectively, and which cooperatively define a mounting seat, two side frame portions each extending downwardly from a corresponding one of said shoulder ends to terminate at a frame end, said side frame portions defining an accommodation space therebetween, two flange portions extending respectively from said frame ends of said side frame portions, and a lighting element which is disposed in said accommodation space, and which includes a circuit board mounted on said mounting seat, and a plurality of light-emitting diodes disposed on said circuit board to give out illuminating light;

wherein said beam module further includes two side covers each of which includes upper and lower abutment walls that are spaced apart from each other in the upright direction so as to permit a corresponding one of said flange portions to be sandwiched therebetween, said lower abutment walls of said side covers extending toward each other beyond said frame ends of said side frame portions, respectively, so as to form two support edges, respectively, and a flat shield disposed under said light-emitting diodes and supported by said support edges.

2. The dual-purpose lighting and ceiling grid framework according to claim 1, wherein each of said front and rear cross beams has said beam module, said dual-purpose lighting and ceiling grid framework further comprising a flexible electrical connecting unit disposed to electrically interconnect said circuit boards of said front and rear cross beams.

3. The dual-purpose lighting and ceiling grid framework according to claim 2, wherein said flexible electrical connecting unit includes a pair of front cables each of which is electrically connected to said circuit board of said front cross beam, and each of which has a front terminal end, a pair of rear cables each of which is electrically connected to said circuit board of said rear cross beam, and each of which has a rear terminal end, and a connector configured to electrically connect said front terminal ends of said front cables to said rear terminal ends of said rear cables.

4. The dual-purpose lighting and ceiling grid framework according to claim 3, wherein each of said front and rear cables is a self-standing cable that supports said connector over said main beam.

5. The dual-purpose lighting and ceiling grid framework according to claim 2, wherein said rear end region of said front cross beam is punched in said vertical web portion of said front cross beam to form a left offset hook tab, and said front end region of said rear cross beam is punched in said vertical web portion of said rear cross beam to form a right offset hook tab, said left and right offset hook tabs being respectively brought into engagement with said slot such that said left and right offset hook tabs are partially overlapped and are juxtaposed with each other to thereby permit said front and rear cross beams to be aligned with each other.

6. The dual-purpose lighting and ceiling grid framework according to claim 1, wherein said lighting element further includes a reflective shade which includes a top mounting wall disposed between said mounting seat and said circuit board, and two reflective walls that extend downwardly from said top mounting wall along said side frame portions, respectively.

7. The dual-purpose lighting and ceiling grid framework according to claim 1, wherein said two flange portions extends away from each other for supporting marginal portions of ceiling panels.

* * * * *